US009300050B2

(12) United States Patent
Laurent

(10) Patent No.: US 9,300,050 B2
(45) Date of Patent: Mar. 29, 2016

(54) MULTIBAND RF ANTENNA

(71) Applicant: BANG & OLUFSEN A/S, Struer (DK)

(72) Inventor: Claude Laurent, Aalborg (DK)

(73) Assignee: BANG & OLUFSEN A/S, Struer (DK)

( * ) Notice: Subject to any disclaimer, the term of this patent is extended or adjusted under 35 U.S.C. 154(b) by 108 days.

(21) Appl. No.: 14/187,948

(22) Filed: Feb. 24, 2014

(65) Prior Publication Data

US 2014/0240185 A1 Aug. 28, 2014

(30) Foreign Application Priority Data

Feb. 22, 2013 (DK) ..... 2013 00105

(51) Int. Cl.

| | |
|---|---|
| ***H01Q 13/10*** | (2006.01) |
| ***H01Q 9/04*** | (2006.01) |
| ***H01Q 1/38*** | (2006.01) |
| ***H01Q 1/48*** | (2006.01) |
| ***H01Q 5/357*** | (2015.01) |

(52) U.S. Cl.

CPC ..... *H01Q 9/0407* (2013.01); *H01Q 1/38* (2013.01); *H01Q 1/48* (2013.01); *H01Q 5/357* (2013.01)

(58) Field of Classification Search

CPC ..... H01Q 5/357; H01Q 1/48; H01Q 1/38; H01Q 9/0407

USPC ..... 343/767, 700 MS, 905

See application file for complete search history.

(56) References Cited

U.S. PATENT DOCUMENTS

| | | | | |
|---|---|---|---|---|
| 6,191,740 | B1 * | 2/2001 | Kates et al. | 343/700 MS |
| 6,937,196 | B2 * | 8/2005 | Korva | 343/702 |
| 6,963,309 | B2 * | 11/2005 | Andersson et al. | 343/702 |
| 7,053,837 | B2 * | 5/2006 | Il et al. | 343/700 MS |
| 8,531,337 | B2 * | 9/2013 | Soler Castany et al. | 343/702 |
| 8,638,271 | B2 * | 1/2014 | Wang et al. | 343/846 |
| 9,088,072 | B2 * | 7/2015 | Takaki et al. | 343/700 MS |
| 2002/0003499 | A1 | 1/2002 | Kouam et al. | |
| 2003/0011521 | A1 | 1/2003 | Edimo et al. | |
| 2004/0021605 | A1 | 2/2004 | Kouam et al. | |
| 2005/0116873 | A1 | 6/2005 | Castany et al. | |
| 2005/0200545 | A1 | 9/2005 | Bancroft | |
| 2011/0037657 | A1 | 2/2011 | Yang | |

FOREIGN PATENT DOCUMENTS

| | | |
|---|---|---|
| EP | 1276170 | 8/2006 |
| GB | 2453160 | 9/2009 |
| WO | WO 03075401 A1 | 9/2003 |

OTHER PUBLICATIONS

Search Report prepared by the Danish Patent and Trademark Office on Oct. 8, 2013, for Danish Patent Application No. PA 2013 00105.

* cited by examiner

*Primary Examiner* — Khai M Nguyen

(74) *Attorney, Agent, or Firm* — Sheridan Ross P.C.

(57) ABSTRACT

This invention relates to a miniature multiband antenna, in which a substrate being the carrier of a conductive element, and the conductive element configured as a layer onto the substrate and being the radiator in form of a slot, and a conductive layer configured onto the substrate and being the antenna feed line in form of a polygon patch area. Alternative embodiments illustrate use of slot type—and meander type antennas. The invention may be applied in any kind of electronic equipment, where a high capacity wireless system is required and within a very small physical embodiment.

10 Claims, 6 Drawing Sheets

MULTIBAND RF ANTENNA

CROSS-REFERENCE TO RELATED APPLICATIONS

This application claims the benefit of Danish Patent Application No. PA 2013 00105 filed Feb. 22, 2013, the entire contents of which are incorporated herein by reference.

TECHNICAL FIELD

This invention relates to a miniature multiband antenna.

BACKGROUND OF INVENTION

Wireless technology allowing streaming contents over the air, requires designing antenna which are small, cheap and allow customers to be exposed to 3D-coverage.

Wireless technology is applied in more and more consumer electronics and general electronics of any kind. The capacity of the wireless equipment is constantly increased in terms of bandwidth and speed, and consequently the demands for smaller and smaller means having higher and higher performance are growing.

The disclosed invention differentiates from prior art, for example exemplified in GB 2453160 in the way that the used ground plane is much smaller.

Furthermore the invention has no distance requirement to the chassis of the apparatus to be fulfilled (conducting frame), subsequently the antenna design according to the present invention is less sensitive to distances to a conductive chassis.

Furthermore the invention is differentiated from known devices in the way that the center coaxial lead or the braid can be attached on any side of the antenna.

Aspects of the invention describe

A miniature multiband antenna configured in a physical construction that is very thin, the construction including first and second parallel conductive elements (1,5,6) separated by a dielectric substrate (2) wherein the antenna comprises:

said substrate (2) has a first side and a second side opposite to the first side and being the carrier of at least said first conductive element (1), where the first conductive element (1) is configured as a layer onto the substrate (2) said first conductive element including a radiator (3,8, 10,20) configured according to a required performance, said second conductive element (5,6) configured onto the substrate (2) as a polygon shaped element, at least part of said second conductive element being the antenna feed line (6) configured according to a required performance, and adapted to have an electromagnetic coupling within the substrate (2), and with a thickness (30) of said first and second conductive layers and said substrate of less than 2 mm.

A multiband antenna where the outline of the polygon shaped structure includes one or more of the geometrical form rectangle or square; and where the feed line is configured as an area defined by the geometrical form rectangle or square; and where the patch is configured as an area defined by the geometrical form rectangle or square.

DESCRIPTION

Figure 4:
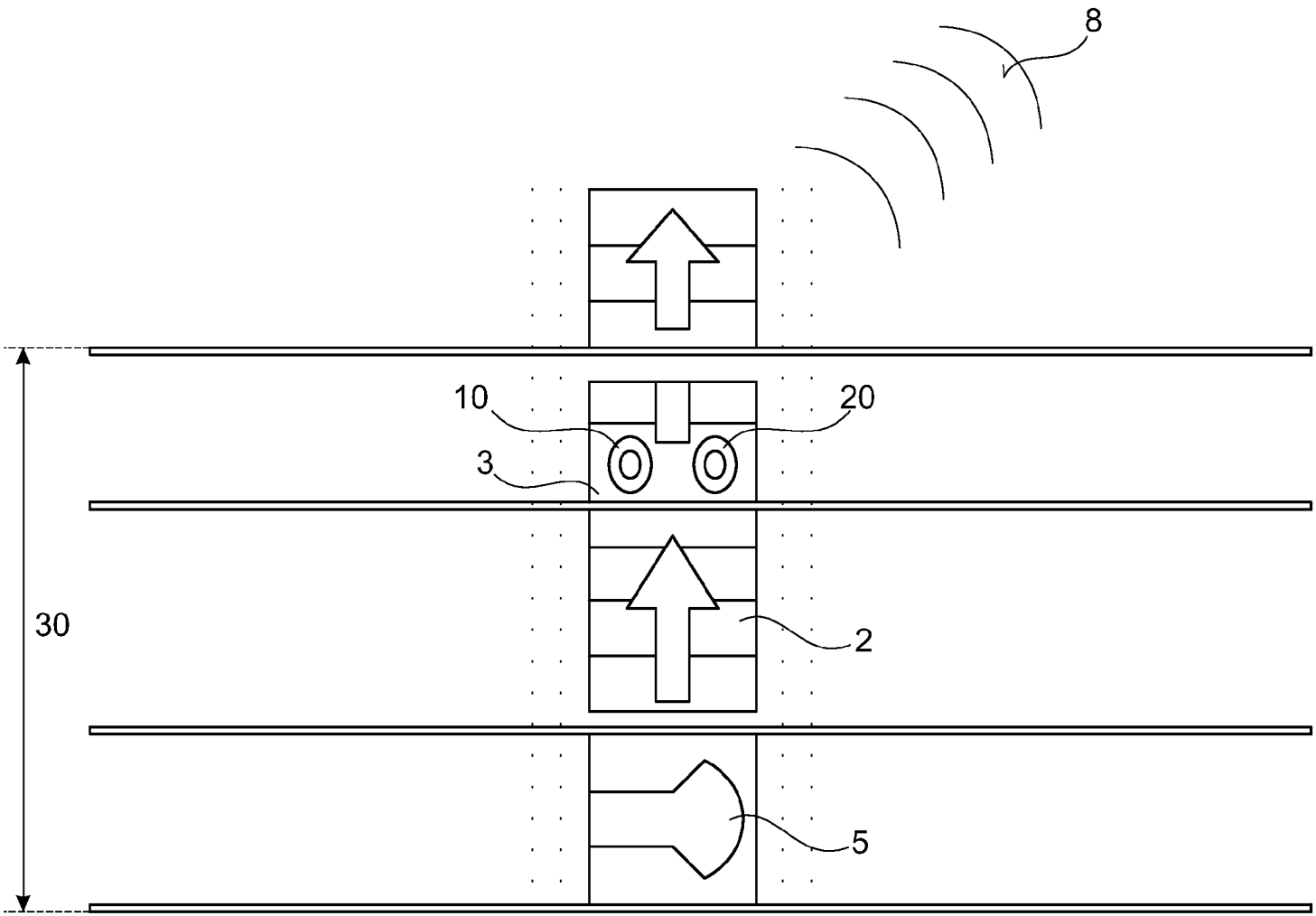
FIG. 4 displays the conceptual model of the invention.

The conceptual model of the antenna in a preferred embodiment is as disclosed in FIG. 4:

The antenna is built with two parallel conductive elements (1,5,6) separated by a dielectric substrate (2).

The two conductive elements are named as a) "Radiative slot" and b) "Strip line". The arcs 8 illustrate the signals being emitted from the antenna.

Figure 1:
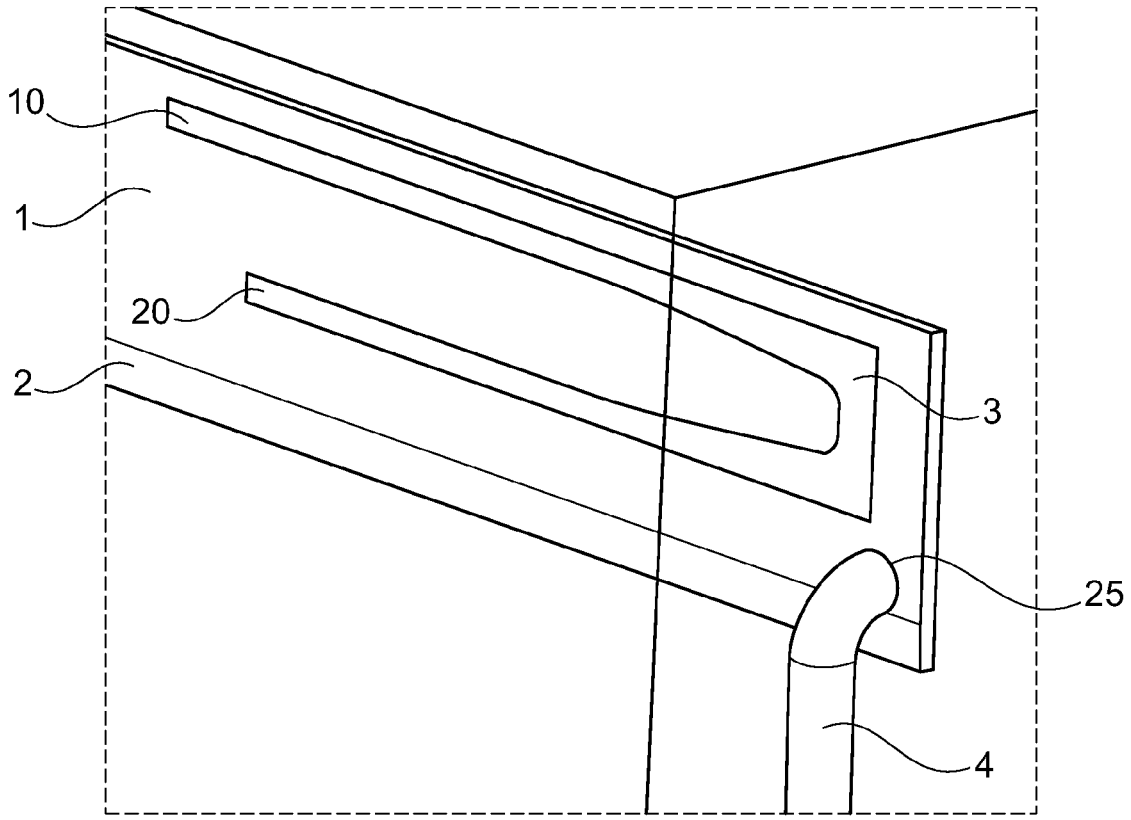
FIG. 1 is an illustration of a first side of an antenna illustrating a slot according to the invention.
Figure 2:
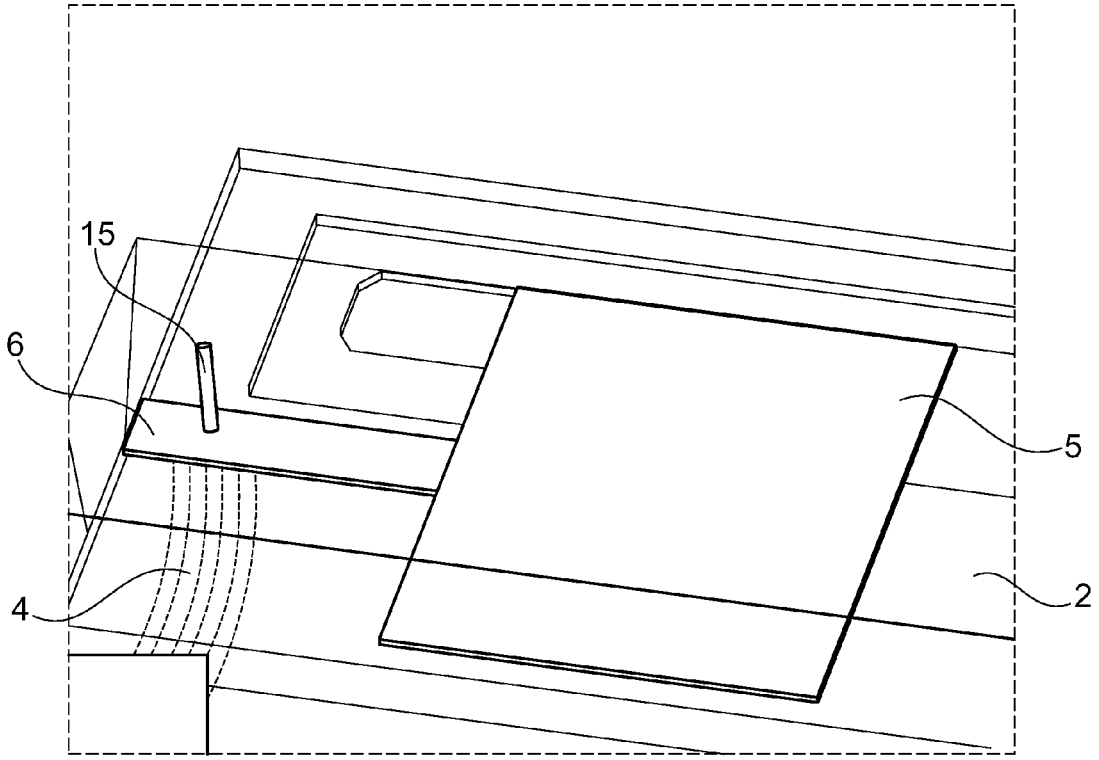
FIG. 2 is an illustration of a second side of an antenna illustrating a patch according to the invention.

In FIG. 1 is illustrated a first side of an embodiment of the antenna, and in FIG. 2 the other side or second side.

The conductive element 1 on the first side is provided with a slot 3, having two arms 10,20. This slot 3 functions as radiator, i.e. radiates signals. A feed cable 4 is connected to the antenna. The feed cable controls the antenna, and is in the shape of a coaxial cable, where the shield of the cable 25 is connected to the first conductive element 1, which thereby is considered as ground plane.

On the second side, see FIG. 2, the second conductive element is in the shape of a feed line 6 connected to a patch 5. The feed line 6 is connected to the coaxial cable's lead 15.

The typical thickness of each of the conductive elements 1,5,6 including the radiative slot and the feed line is 50 μm and the thickness of the substrate is 500-1000 μm, thus the total thickness (30) is approximately less than 2 mm.

One conductive element is carrying the strip line associated to the coupling patch (5). The other conductive element is carrying the U shaped slot (3), and with the arms of the U being radiative elements (10, 20). These as displayed on FIG. 1 with the notation "first arm" and "second arm".

In FIG. 2 is illustrated how the antenna is connected to the RF transceiver using a coaxial cable line (4). The coaxial line's center line (15) (Signal) is connected to the feed line (6). The coaxial shielding—shield 25 (Reference Voltage) is connected to the antenna ground 1 where a slot 3 has been formed.

The feed line 6 acts to match the RF transceiver front end impedance to the antenna interface impedance; for the current design this is 50 ohm.

The patch (5) associated to the feed line (6) acts to generate electrical field in "Transmit Mode" or to transform electrical field into voltages in "Receive Mode".

The electrical field is confined in the substrate 2 in between the antenna patch 5 and the antenna ground 1. The electromagnetic coupling is a compound field of electrical and magnetic fields, and it takes place in the substrate (2).

Figure 6A:
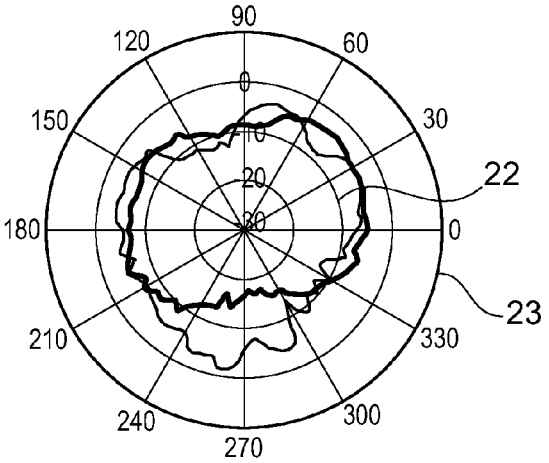
FIGS. 6*a-c* display a radiation pattern for an embodiment of the invention.
Figure 6B:
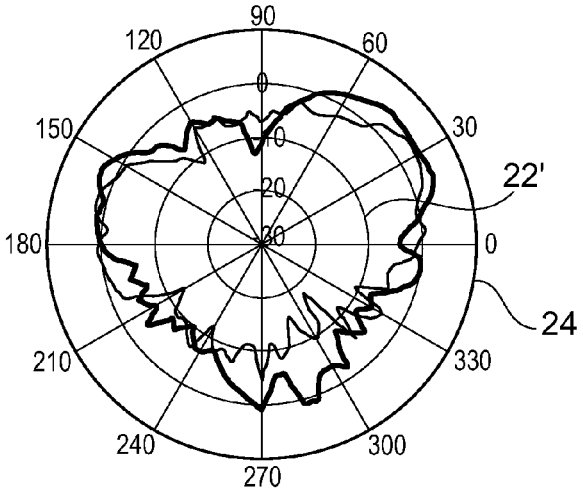
Figure 6C:
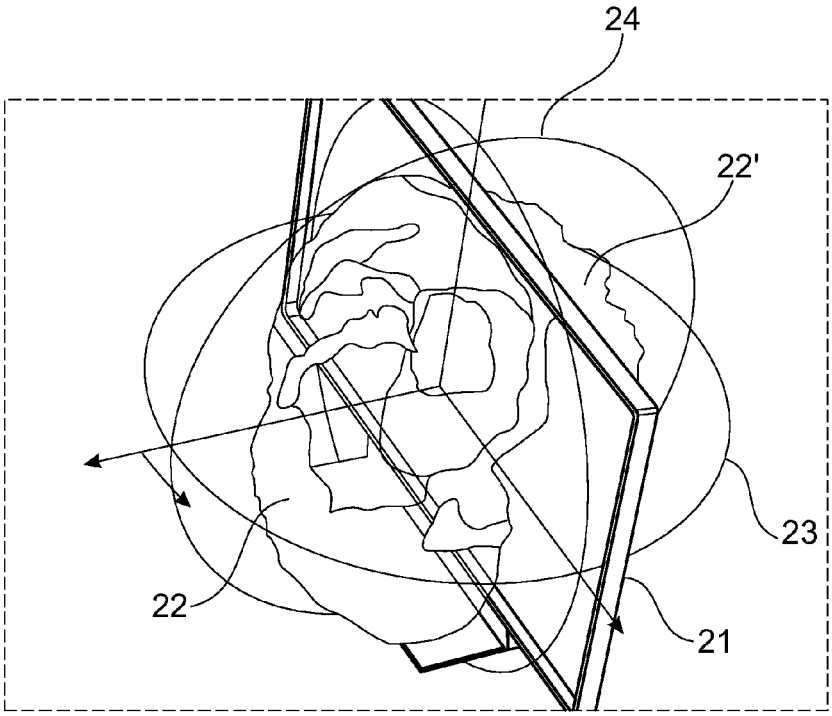

The slot 3 is designed to be resonant at two or more frequencies and allow the electrical field for radiating in specific directions and with specific polarization, see example in FIG. 6*a-c*.

Figure 3:
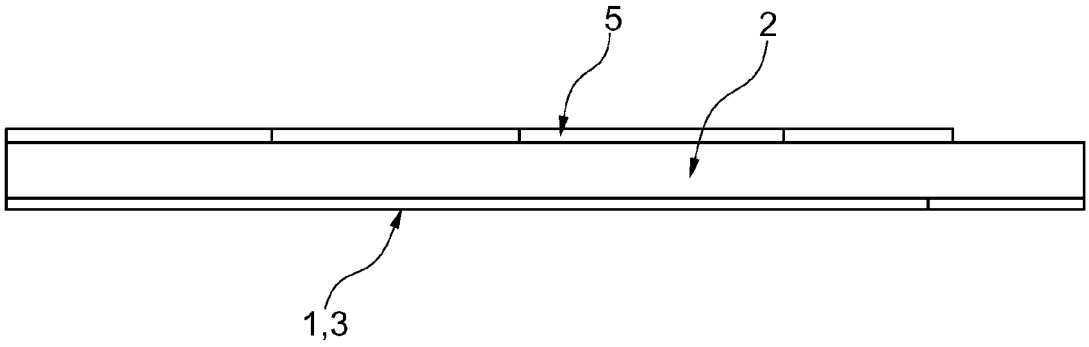
FIG. 3 displays a transversal section of the invention.

FIG. 3 displays a transversal section of the invention illustrating the layer structure including the substrate (2), the slot (3) and the patch (5).

Thus, another aspect of the invention is:

the substrate has a first side and a second side opposite to the first side;

the slot is placed on the first side and the patch is placed on the second side.

FIG. 1 displays a preferred embodiment of the invention (1) and specifically the slot (3) element located onto the substrate (2).

The slot (3) is an opening that is created in a Solid Conductive Ground Plane, and the slot 3 is designed to resonate at specific frequencies applicable for e.g. WiFi and Bluetooth.

The feed cable (4) is entering the device at this side of the device and the shield 25 of the cable is connected to the ground plane 1.

The slot 3 is designed with two openings 10,20 to get a dual band antenna. Each of these arms (10,20) allows tuning the lowest and/or the highest resonance with a certain level of dependency.

The advantage of using a slot 3 is based on the less sensitivity of conductive parts in the environment of the antenna.

Thus, yet another aspect of the invention is:

- the slot and the patch interact via electromagnetic means;
- the feed cable is connected to the feed line through an entry from the first side;
- the feed cable shield is connected onto the ground plane on the first side;
- the feed cable lead is connected to the feed line on the second side.

FIG. 2 displays a preferred embodiment of the invention and specifically the patch (5) element. In FIG. 2 the substrate 2 is made transparent in order to illustrate the cable 4 on the other side of the antenna.

The feed line (6) is a conductive element that couples the center of the coaxial cable, i.e. the signal (15), to the patch (5). The feed cable shield 25 is used as reference plane.

The patch (5), which has no galvanic contact to the radiator (1), is designed to provide adequate LC loading to the patch in order to allow trimming the impedance and bandwidth of the antenna.

The patch is left open which means that it is not connected to the ground. The only connection is through the coaxial cable center lead 15 that allows to set-up the adequate characteristic impedance.

The patch might have different topologies dependent of the antenna's RF specification. The referred topologies being e.g. square, triangle, L-formed, or U-formed.

The invention is especially suitable for Wifi Bluetooth applications, in frequency domains like 2.4-2.484 GHz and 5.9-6.9 GHz.

In a preferred embodiment physical dimensions are with unit in metric mm:

- conductive element including the slot: Size: 10×50 mm, area 500 mm2
- Patch size: 5×3 mm
- Feed line width/length: 2×20 mm Material for the dielectric substrate (2) is any of all types: FR4, Ceramics and alike. The conductive elements may be copper, silver or alike.

Figure 5:
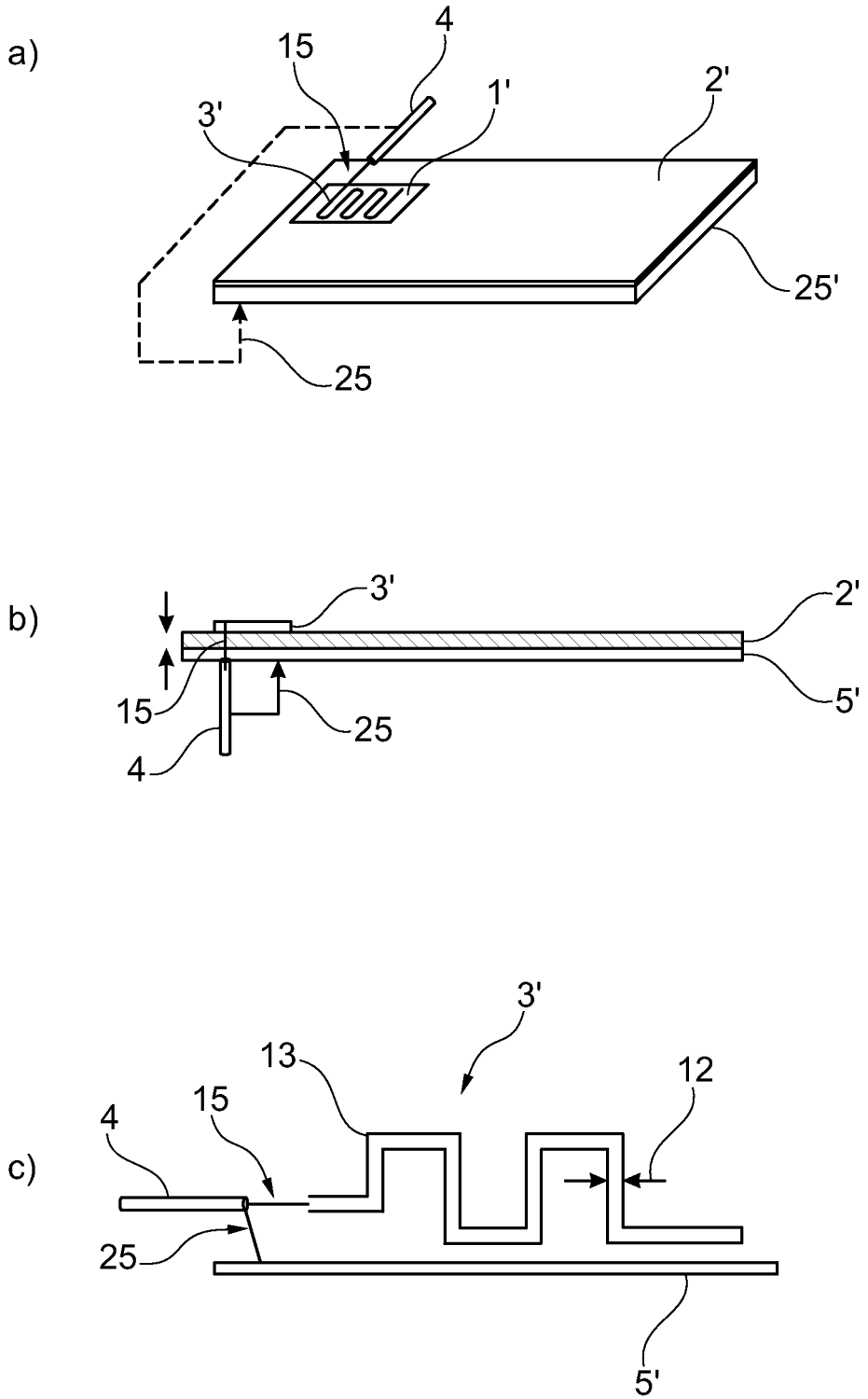
FIGS. 5*a-c* illustrate an embodiment of the invention.

FIGS. 5*a*-*c* display an alternative embodiment of the invention:

FIG. 5-*a* illustrates a perspective view showing the layered construction of the antenna device including: a metallic surface of the application apparatus, i.e. the apparatus where the antenna according to the invention is built in, this having an isolating layer 2' on top of the surface—corresponding to the substrate, the isolating layer being configured with a meander 3' shaped objet to act as an active element—corresponding to the radiator in an antenna device. Typically the characteristic of a meander 3' is that it has a regular zig-zag form.

The shield 25 of the cable 4 is connected to the surface of the apparatus, and the cable lead 15 to the meander 3'

Thus in summary:

- The surface plate of an apparatus acts like an antenna patch 5' and the grounded reference layer.
- An oxide layer on top of the surface acts like the insulating substrate 2' of the antenna radiator in the form of a meander 3'.
- The signal cable 4 is attached to the meander 3' and shielded 25 to the ground 25', i.e. to the metal surface of the apparatus being the reference plan (1).

The materials applied in the construction are e.g. but not limited to:

- The surface plate of an apparatus may be configured as a plate of Alumina ($Al_2O_3$). This may be produced as an anodized aluminum plate. The layer of oxide may be in the range of 30 μm–>200 μm. It is an advantage to apply a substrate having a high permeability constant, i.e. a good dielectric like $SiO_2$ with $\in$=12 or $Al_2O_3$ with $\in$=8.
- The meander may be produced by standard methods by vaporizing conductive lines onto a substrate, e.g. using silver, gold, graphite or copper as the conductive material. An alternative method may be to inject conductive Nano particles into the micro holes that appear on the surface oxidized metal. The method of which is disclosed by the applicant in DK PA 2007-01024.

FIG. 5-*b* illustrates a side view of the antenna, with the center wire 15 of the coaxial cable (signal) 4 connected to the meander 3' configured on top of the oxide layer 2' and the shield 25' connected to ground 25. The signal connection is through the coaxial cable center wire 15 that allows to set-up the adequate characteristic impedance.

The active antenna element is configured like a meander 3' in a shaped form that is designed to provide adequate LC loading to the patch to allow trimming the impedance and bandwidth of the antenna.

The outline of the meander 3' may have different topologies depending of the antenna RF specification and the industrial design of the application apparatus.

FIG. 5-*c* illustrates details in the meander 3'. The meander 3' is designed so to resonate at specific frequencies and for the given example that is suitable for wireless remote control device with low effect e.g. 1 w–>5 w.

The contour of the form of the meander 3' is like a square pulse and where the width 12 of the meander line 13 is approximately 3 to 5 times the thickness of the oxide layer 2'. For example with an oxide layer of 50 μm the width 12 of the meander line 13 is 150 μm. Is the number of square pulses of the meander line 13 ten, the length of the meander 3' becomes approximately 3 mm.

FIGS. 6*a*, 6*b* and 6*c* display the antenna radiation pattern in free space and is expected to be perpendicular to the radiator.

In FIG. 6*c* is illustrated an apparatus, in this example a flat screen TV 21. The radiated antenna signals 22,22' are depicted as "clouds" on the front and rear sides of the apparatus 21. The circles 23,24 illustrate various planes through the clouds 22,22' depicted in FIGS. 6*a* and 6*b*.

FIGS. 6*a* and 6*b* consequently illustrate that the antenna according to the invention built into the apparatus 21 projects substantially a homogeneous 3D radiation signal.

The shape form of the meander 3' may be designed as parallel lines, squared, shaped in a circle or any other geometrical form according to the actual apparatus' functional requirements and type of wireless communication needed.

The advantage of using a meander 3' implies less sensitivity to conductive parts in the environment of the antenna.

The invention as disclosed may be applied in any kind of electronic equipment, where a high capacity wireless system is required and within a very small physical embodiment. These applications being media players, mobile phones, smartphones, tablets, remote terminal, system controllers, laptops, PCs, TVs, audio systems, cameras and the like.

The invention claimed is:

1. A miniature multiband antenna configured in a physical construction that is very thin, the construction including first and second parallel conductive elements separated by a dielectric substrate wherein the antenna comprises:

said substrate has a first side and a second side opposite to the first side and being the carrier of at least said first conductive element, where the first conductive element is configured as a layer onto the substrate said first conductive element including a radiator configured according to a required performance, said second conductive element configured onto the substrate as a polygon shaped element, at least part of said second conductive element being the antenna feed line configured according to a required performance, and adapted to have an electromagnetic coupling within the substrate, and with a thickness of said first and second conductive layers and said substrate of less than 2 mm.

2. A multiband antenna according to claim 1, where the radiator is configured as a slot.

3. A multiband antenna according to claim 2, where the slot is placed on the first side and the patch is placed on the second side.

4. A multiband antenna according to claim 2, where the slot and the patch interact via electromagnetic means and the patch has no galvanic contact to the radiator.

5. A multiband antenna according to claim 1, where the radiator is configured with the form as a meander.

6. A multiband antenna according to claim 1, where the feed line is configured to include a patch area.

7. A multiband antenna according to claim 1, where the antenna is connected to electronics by a feed cable, said feed cable being a coaxial cable at least having a shield and a center lead, where the shield of the feed cable is connected to the first conductive element.

8. A multiband antenna according to claim 7, where the feed cable shield is connected onto the first conductive element on the first side.

9. A multiband antenna according to claim 7, where the feed cable lead is connected to the feed line on the second side.

10. A multiband antenna according to claim 1, where the feed cable lead is connected to the feed line through an entry from the first side.

* * * * *